US006029317A

United States Patent [19]

Meile et al.

[11] Patent Number: 6,029,317

[45] Date of Patent: Feb. 29, 2000

[54] SPINNING PREPARATION DEVICE

[75] Inventors: Karl Meile, Rickenbach; Jürg Faas, Andelfingen, both of Switzerland

[73] Assignee: Maschinenfabrik Rieter AG, Winterthur, Switzerland

[21] Appl. No.: 09/063,700

[22] Filed: Apr. 21, 1998

[30] Foreign Application Priority Data

Apr. 22, 1997 [DE] Germany ..... 197 16 792

[51] Int. Cl.[7] ..... D01G 13/00

[52] U.S. Cl. ..... 19/145.5; 19/65 A; 19/200

[58] Field of Search ..... 19/65 A, 66 R, 19/65 R, 81, 97.5, 96, 204, 200, 202, 203, 205, 105, 145.5, 300, 303

[56] References Cited

U.S. PATENT DOCUMENTS

| | | |
|---|---|---|
| 3,829,934 | 8/1974 | Neu . |
| 3,889,319 | 6/1975 | Roberson . |

FOREIGN PATENT DOCUMENTS

| | | |
|---|---|---|
| 0381860 | 8/1990 | European Pat. Off. . |
| 0412447B1 | 6/1994 | European Pat. Off. . |
| 0810309A1 | 12/1997 | European Pat. Off. . |
| 2217394 | 12/1972 | Germany . |
| 2436096 | 4/1975 | Germany . |
| 4430332A1 | 2/1996 | Germany . |
| 19516568 | 11/1996 | Germany . |
| 19516569 | 11/1996 | Germany . |
| WO9635831 | 11/1996 | WIPO . |

OTHER PUBLICATIONS

Patent Abstracts Of Japan No. 58070714, Published Apr. 27, 1983.

European Patent Office Search Report, Aug. 17, 1998.

*Primary Examiner*—Michael A. Neas
*Assistant Examiner*—Gary L. Welch
*Attorney, Agent, or Firm*—Dority & Manning

[57] ABSTRACT

A spinning preparation process and device with a mixer (3) for mixing fibers, with a withdrawal apparatus (10) for withdrawing fibers from the mixer (3) and a separating device (4), arranged downstream of the same in the conveying direction of the fibers, for separating foreign matter from the fibers, characterized in that the separating device (4) is arranged immediately downstream of the withdrawal apparatus (10), the fibers are taken from the withdrawal apparatus (10) as a fiber fleece (22) which is spread out transversally to the conveying direction of the fibers and are thus supplied to the separating device (4), and the fiber fleece (22) is examined by the separating device (4) for foreign matter and is substantially cleaned from the same.

14 Claims, 4 Drawing Sheets

SPINNING PREPARATION DEVICE

BACKGROUND OF THE INVENTION

The present invention relates to a spinning preparation process and device with a mixer for mixing fibres and with a withdrawal device for withdrawing the fibres from the mixer, and a separating device for separating foreign matter from the fibres.

The spinning preparation device in accordance with the invention is mainly used in blowroom lines for the preparation of cotton in order to prepare the same for spinning. Blowroom lines consist substantially of a bale opener which opens the supplied raw cotton, which is then further conveyed in the form of flocks. In this process, coarse impurifications of the cotton are separated. Usually, the fibre flocks then come into a mixer which ensures a thorough mixing of the fibre flocks by way of various chutes, for example. The fibres are then taken from the mixer by means of an elevator lattice and are conveyed further on.

From DE 195 16 568 it is known to arrange a separating device downstream of a bale take-off machine or a mixer, which separating device is used for separating foreign matter from the fibres. In this separating device, the fibre flocks are conveyed by way of a pneumatic conveyance from the preceding machine, such as a mixer, to a filling chute from where they are taken out by way of an opening device. The opening device consists of a slowly revolving draw-in roller and an associated opening roller, for example. The fibres taken by the opening device from the filling chute fall into a chute-like chamber which is part of a separating device for separating foreign matter from the fibres. For this purpose, the opened fibre flocks move past an optical sensor system in free fall in the form of a kind of fibre fleece.

The cotton opened into fibre flocks not only contains natural impurifications such as dust or trash particles, but also foreign matter such as fabric made of jute or cotton, strings, webs or plastics of all kinds as well as fibre flocks which are soiled with oil to such an extent that their further presence would considerably impair the further processing of the cotton. These impurifications are recognized in the known apparatus by means of optical colour sensors and removed from the free-falling stream of flocks by way of a controlled blow-out device.

From DE 44 30 332 A1 a separating device for separating foreign matter is known in which fibre flocks pneumatically supplied in a conveying chute are condensed. The fibres are conveyed past a wall for the optical recognition of foreign matter by means of a conveyor belt. As a result of the wall, such as a glass plate, for example, and the conveyor belt, the fibre flocks are formed into a fleece and conveyed in this form past the optical sensors of the separating apparatus by the conveyor belt. The optical sensors are arranged at the glass wall and can thus recognize the imperfections.

The known spinning preparation devices with a separating device for separating foreign matter have the disadvantage that the fibre flocks, before they reach the separating device, have to be subjected to a renewed treatment after having been pneumatically conveyed. This is necessary in order to prepare them in such a way that they can be supplied to the separating devices in the required form in order to recognize the foreign matter. For this purpose they are re-condensed and then opened into flocks again, or taken from a conveying chute and formed into a fibre fleece. A condension of the fibres is also made, for example, when the fibres are conveyed from the spinning preparation device to the separating device by means of pneumatic lines, which means the separation of conveying air. For the recognition of foreign matter, it is advantageous, however, if the fibres are present in the thinnest possible fibre or flocked fleece so that the foreign matter cannot be covered by batch fibres and thus cannot be recognized. These renewed treatments require considerable efforts both in construction and lead to high energy (and air) consumption.

OBJECTS AND SUMMARY OF THE INVENTION

It is thus a principal object of the present invention to avoid additional steps in the fiber treatment as far as possible and to maintain advantageous forms of the flow of flocks. Additional objects and advantages of the invention will be set forth in part in the following description, or may be obvious from the description, or may be learned through practice of the invention.

The objects are achieved in accordance with the invention by an embodiment of a spinning preparation device in such a way that the separating device is disposed immediately downstream of the withdrawal apparatus. The fibres are taken from the withdrawal apparatus as a fibre fleece which is spread out transversally to the conveying direction of the fibres and are thus supplied to the separating device. The fibre fleece is examined by the separating device for foreign matter and is substantially cleaned from the same. The embodiment of the spinning preparation device in accordance with the invention ensures that additional devices can be omitted which would otherwise become necessary in order to supply the fibres to the separating device in an advantageous manner. The favourable form of feed of the fibres need no longer be given up when the fibre flocks for example are present at the end of the mixing process in form of a fleece. Its favourably wide and thus thin arrangement is retained. This is particularly advantageous for the recognition of foreign matter. A further advantage is that any additional intervention on the fibres can be avoided, so that any mechanical stress on the fibres is omitted. Moreover, this leads to the advantageous achievement that the spinning preparation device can be provided with a shorter length, as an additional apparatus can be saved.

The arrangement of the separating device immediately downstream of the withdrawal apparatus of the mixer is particularly advantageous, because the mixer is a kind of ventilation unit for pneumatically conveyed fibre flocks. It was therefore not necessary to provide a flock ventilation unit especially for the separating device, which from an energy viewpoint is advantageous. In the present invention, it was recognized that there are ideal conditions for fibre preparation immediately after the withdrawal device in order to recognize and separate foreign matter which is mixed with the fibres. As a result of the fact that the fibres are present in a ventilated condition, they can be supplied optimally to the separating device as fibre fleece and can be cleaned. Moreover, they need not be conveyed by way of pneumatic lines to and from the separating device. The risk of the formation of neps is thus reduced.

In a further embodiment of the invention, it is provided that the mixer of the spinning preparation device is a tower mixer. This helps to achieve a thorough mixture of the fibres and a simple withdrawal of the fibres by means of an advantageous elevator lattice for example. The use of an elevator lattice leads to the advantage that the fibres can be taken from the mixer in the form of a fleece or a lap.

As a result of the elevator lattice, it is achieved that a homogenous fleece arises and can be supplied to the separating device.

It is preferable if a conveying device is provided downstream of the separating device. A pipeline with an air stream has proved to be beneficial, as in this way the fibre flocks can be conveyed further in an easy and secure manner.

It is particularly advantageous if the separating device is provided with optical colour sensors for recognizing imperfections, as in this way it is ensured that the imperfections can be separated without having to separate fibres in the batch.

Particularly favourable is the use of CCD cameras for the secure recognition of foreign matter and their differentiation from fibres in the batch. Pneumatic nozzles are particularly suitable for the secure removal of foreign matter, as they operate practically without any delays and with high force. Foreign matter is removed particularly securely by means of flaps grasping into the fibre stream. The arrangement is particularly favourable in which the fibres move past the separating device in free fall, as they are thus flexible for the application of various means for the removal of foreign matter such as flaps, pneumatic nozzles or grippers.

The invention is now explained below in closer detail by reference to representations shown in the drawing.

DETAILED DESCRIPTION

Figure 1:
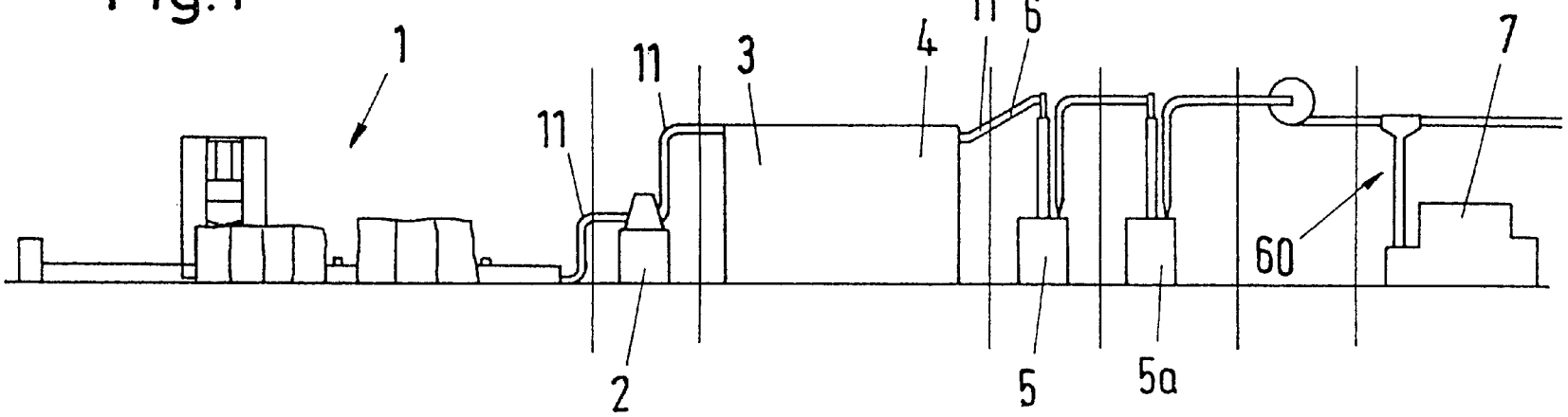
FIG. 1 shows a spinning preparation device in the form of a blowroom installation in a schematic representation.

Reference will now be made in detail to the presently preferred embodiments of the invention, one or more examples of which are shown in the drawings. Each example is provided by way of explanation of the invention, and not as a limitation of the invention. For example, features illustrated or described as part of one embodiment, can be used with another embodiment to yield still a further embodiment. It is intended that the present invention include such modifications and variations.

The spinning preparation device of FIG. 1 shows a complete blowroom line. It consists of a bale opener 1 which is provided downstream with a coarse cleaning unit 2 (e.g. according to EP-B-381 860). Both are connected by way of a pneumatic pipeline 11 which conveys the fibre flocks from the bale opener 1 to the coarse cleaning unit 2. After the coarse cleaning unit 2, the fibre flocks are conveyed by means of a pneumatic pipeline 11 to a mixer 3 where the fibres are mixed prior to further processing. The fibre flocks are conveyed in a cloud-like manner in the pneumatic pipelines. They are mixed in partly thick balls and are penetrated with foreign matter prior to their cleaning.

Various arrangements of mixers are available for mixing the fibres. In the present case, it concerns a tower mixer 3 (see FIG. 2) in which the fibres are deposited in various chutes 31 from where they are taken again so as to produce a thorough mixture. The conveying air must be separated when the flocks are deposited in the chutes 31. The fibres are taken out by means of an elevator lattice 10 which moves along the chutes 31 or the fibres which are contained therein. The withdrawal can also occur below the chutes in another kind of mixer, as opposed to the lateral manner of withdrawal as is shown and described herein. In this process, the fibres are withdrawn below the chutes and conveyed by means of a conveyor belt, similar to the elevator lattice, to the front side of the mixer. The elevator lattice 10 or the conveyor belt transfers the fibres in the form of a fleece to a separating device 4. In the separating device 4, the fibres of the batch material are separated from foreign matter by the removal of this foreign matter.

After the separation of the foreign matter, the cleaned fibres are transferred from the separating device 4 to a conveying device 6 in the form of a further pneumatic pipeline 11 and, by way of the same, reach a device 5 for fine cleaning (e.g. according to U.S. Pat. No. 5,123,145) which is followed downstream by an apparatus for intensive cleaning 5*a*. After leaving the intensive cleaning 5*a*, the fibres reach a card feeder 60 which supplies several cards 7 with fibres or fibre flocks (e.g. according to EP-B-303 023). FIG. 1 shows the relevant blowroom machines of a blowroom line. In individual cases certain machines such as the intensive cleaning may not be required or individual machines as described can be present several times.

Figure 2:
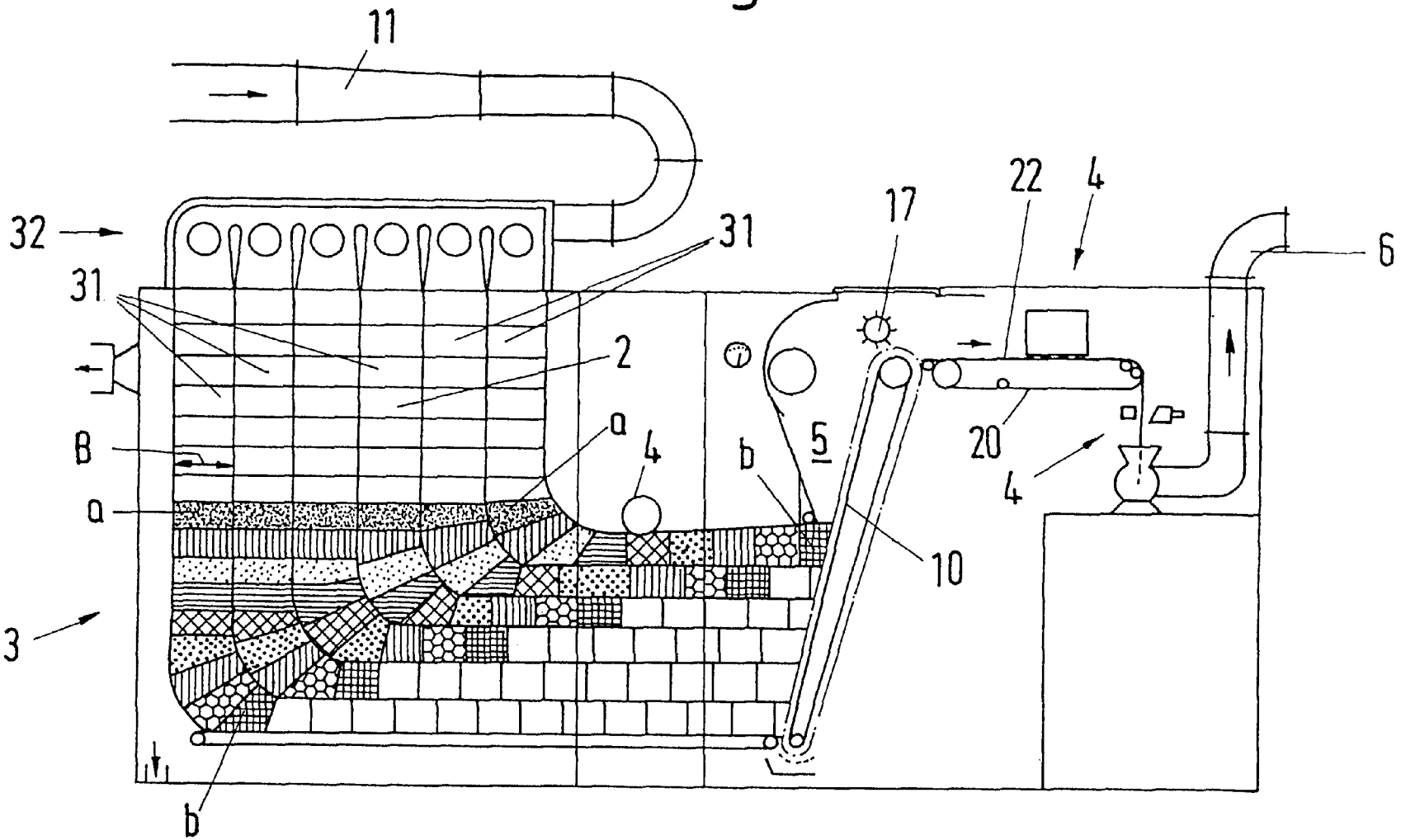
FIG. 2 shows a tower mixer in a sectional view with a separating device provided downstream.

FIG. 2 shows the tower mixer 3 of FIG. 1 in a sectional view. The tower mixer 3 is subdivided into different chutes 31 which are open on their upper side and are connected to the pneumatic pipeline 11. The arriving fibre flocks are distributed evenly among the various chutes 31 by means of a distributor 32. After the distributor 32, the chutes 31 extend at first in the perpendicular direction before making a 90° bend, so that the chutes 31 and their fillings with flocks now extend in the horizontal direction. Their horizontal extension ends before the elevator lattice 10 which moves past all chutes substantially in the perpendicular direction upwards from below and takes out fibres. This arrangement of the mixer as a tower mixer 3 leads to the consequence that, owing to the different lengths of the chutes 31, namely the lengths of the paths that the fibres have to cover, the fibres are taken later from the chute 31 which is shown on the left than from the chute shown on the right. This is shown diagrammatically on the basis of the different seraphs. Whereas the fibres (as represented by seriph a) are located at first at the same level in their chutes 31, the fibres that reached chutes 31 simultaneously (recognizable with seriph b) will reach the elevator lattice 10 at different times and will be withdrawn at different times although they reached the chutes 31 at the same time. This leads to a thorough mixture of the fibres and fibre flocks with fibres and fibre flocks which were supplied to the mixer at other times and thus from other bales.

Once the fibres have been taken from the chutes 31 by the elevator lattice 10, the fibres are substantially transported perpendicularly upwardly and are transferred by the elevator lattice 10, which cooperates with a back stripping roller 17, to a conveyor belt 20 which extends substantially horizontally. The fibres are present on the conveyor belt 20 in the form of a fleece 22, with the fleece substantially having the same width as the depth of the chutes 31. The depth of the chutes 31 is longer than its width B. The width of the fleece can be approx. 1000 mm for example, or can even be more.

Figure 3:
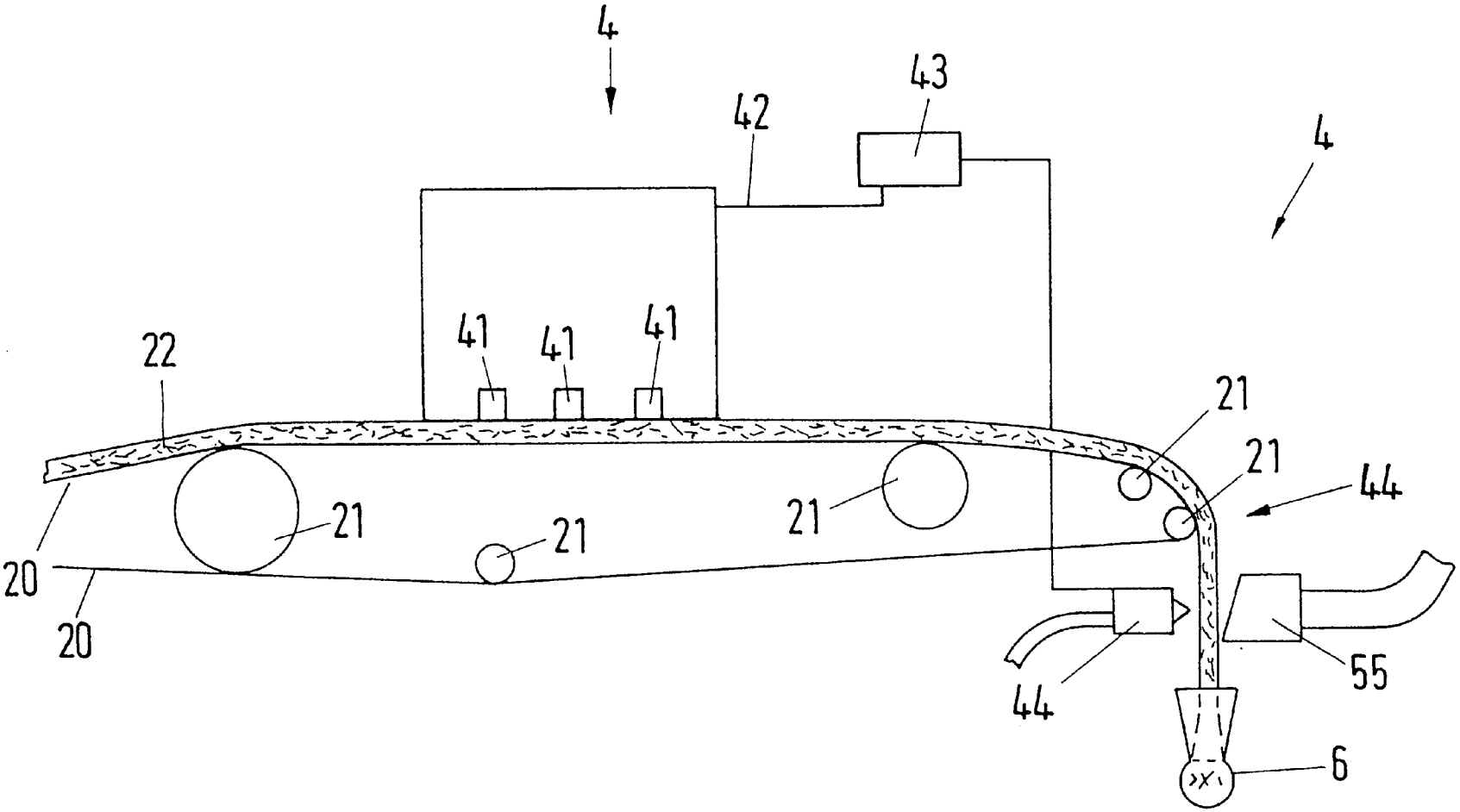
FIG. 3 shows a schematic representation of the separating device of FIG. 2.

The conveyor belt 20 is a part of the separating device 4 (cf. FIG. 3). After passing the separating device 4, the fibres are received by the conveying device 6 and supplied to the fine cleaner 5 (cf. FIG. 1). After transferring the fibre flocks from the elevator lattice 10 to the conveyor belt 20, they have not substantially changed their form, i.e. their presence in the form of a fleece.

Figure 2A:
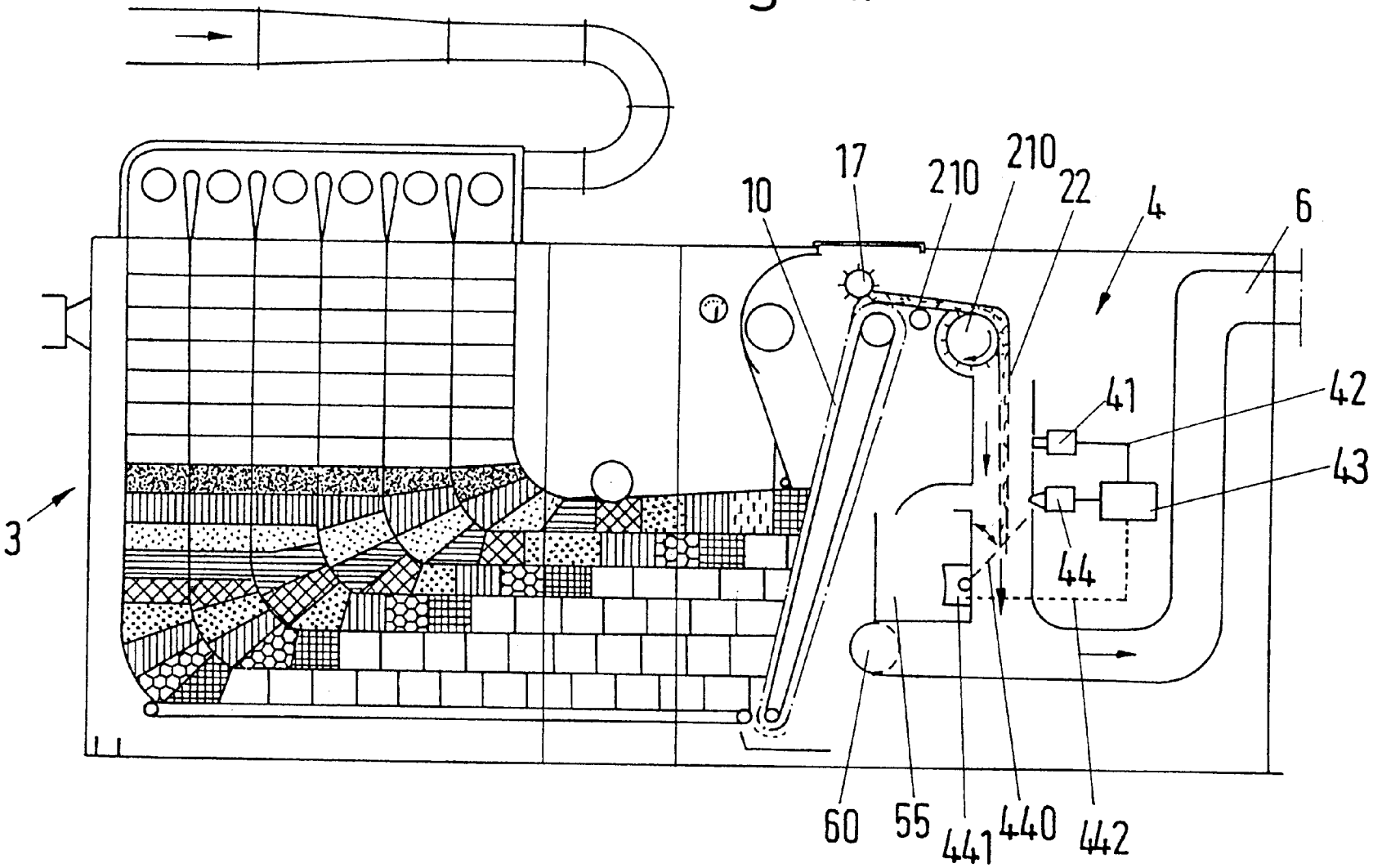
FIG. 2*a* shows an apparatus in accordance with the invention similar to FIG. 2 with another separating device.

FIG. 2*a* also shows an apparatus in accordance with the invention which is similar to that of FIG. 2. The separating device 4, however, does not comprise a conveyor belt. Instead, the fibre fleece which is received from the elevator lattice 10 is supplied to the separating device 4 by way of conveyor rollers 210. It is arranged in FIG. 2*a* in such a way that the fibre fleece moves in the perpendicular direction both before the sensors 41 as well as the blow-out nozzles 44. For this purpose, the fleece is subjected to a deflection of approx. 90° by way of the right conveying roller 210. The separating device 4 of FIG. 2*a* also comprises a computer 43 which is connected with the optical sensors 41 by way of a data line 42. It is similarly connected in respect of control with the blow-out nozzles 44. The sensors 41 are arranged in a horizontal row on the side of the fibre fleece 22 which is averted from the mixer 3. For the optimal recognition of foreign matter, it may also be provided that further sensors (not shown) are assigned to the sensors 41 which are arranged at approximately the same height on the side of fibre fleece 22 which faces the mixer 3. The separating device 4 is also provided with a plurality of blow-out nozzles 44 for removing foreign particles. In addition, the separating device 4 may alternatively be equipped with flaps 440 which swivel into the fibre stream by way of a swivelling actuator when a foreign particle needs to be removed from the stream of flocks. For this purpose, the swivelling actuator 441 is connected with the computer 43 by way of a control line 442. Preferably, several flaps 440 are arranged horizontally next to one another in such a way that only the foreign particle and no good fibres are removed. The flaps conduct the foreign particles to a collecting container 55 from which they are disposed of by suction.

As in FIG. 2, the fibre fleece 22 is supplied advantageously in accordance with the invention in the form of the favourable spreading as supplied by the elevator lattice to the separating device 4. For this purpose, the fibre fleece need not preferably be conveyed in a pneumatic manner, as it may also occur preferably here by way of conveying rollers in a fibre-protecting manner. Alternatively, it may be provided that in the zone of the sensors 41 the fibre fleece does not flow freely downwardly, but is guided by chute walls. For carrying off the cleaned fibres, air is supplied by way of a line 60 which entrains them and conveys them further to the next processing machine by way of a conveying device 6.

Similar to those in FIG. 2, the sensors 41 form an optical colour sensor system, i.e. an optical recognition system such as one or several CCD cameras, as are known from the state of the art.

As a result of the advantageous supply of the fibres from the mixer to the separating device 4 by means of mechanical transport, it is possible to arrange the separating device 4 as a module which can optionally be integrated in the blowroom line instead of a cleaner, for example (cf. FIG. 1). Similar to the process where the known cleaners receive the fibre flocks from mixer 3 by means of the elevator lattice 10 without using the help of pneumatic conveying means, the apparatus of FIG. 4 in accordance with the invention can be integrated optionally instead of the cleaner in the blowroom line without any major reconstruction measures. In this respect, it is particularly advantageous that the separating device, once it has removed the foreign particles from the fibre stream, further conveys the fibres pneumatically like the cleaners, for example, so that after the separating device it is not necessary to take any new measures for the conveyance of the fibres.

FIG. 3 shows the conveyor belt 20 which is guided over conveying rollers 21 and conveys the fibre fleece 22, coming from the mixer 3, along the separating device 4. The separating device 4 comprises optical sensors 41 which recognize foreign particles in the fibre fleece 22 and report this to a computer 43 by way of a dataline 42. Over its further progress, the fibre fleece 22 is subjected to a deflection 44 where subsequently blow-out nozzles are arranged which are in connection with the computer 43 and are controlled by the same. The blow-out nozzles 44 produce a compressed air blast which removes the foreign matter components from the fibre fleece 22. Thereafter, the same reaches a conveying device 6 which is arranged in the form of a pneumatic pipeline and conveys the fibres to the next blowroom machine. The imperfections reach a collecting container 55 and are discharged from the same by suction.

A glass plate is disposed between the optical sensors 41 and the fibre fleece 22 which is cleaned by the passing fibre flocks. The conveyor belt 20 and the glass surface between the separating device 4 in the zone of the sensors 41 form a hollow chute chamber. FIG. 3 only shows a principal representation similar to a sectional representation. The depth extends substantially to a width as is predetermined by the elevator lattice. The optical sensors 41 can consist of photodiodes, for example, which are arranged for the recognition of different colours. Similarly, the optical sensors can be optically connected by way of optical waveguides with the fibre fleece, as is also the case with the lighting required for this purpose.

The sensors 41 are arranged in different rows as seen in the direction of flow and extend transversally to the depth of the representation of FIG. 3 according to the width of the fibre fleece 22. The sensors 41 are arranged in such a way that in total the entire fleece 22 can be detected optically. The individual sensor 41 only sees a relatively small area in the magnitude of square centimeters. The fibre fleece is illuminated with a constant light which the sensors 41 supply to their observation zone themselves. The reflected light is recognized separately according to the individual colour components and is evaluated by the evaluating unit, the computer 43, in conjunction with data on the intensity of the reflected light and further information. According to the program as determined in the control, the ejection mechanism assigned to the respective sensor 41 is activated by the computer 43 at the correct time. In order to trigger the ejection of the foreign particles in the fibre fleece (e.g. the blow-out nozzles 44 in this case) at the right time, the separating device is provided particularly preferably with a sensor (not shown) which recognizes the speed of the fibre fleece 22 and forwards this information to the computer 43. If blow-out nozzles 44 are used, they preferably comprise a common compressed air supply.

Figure 4:
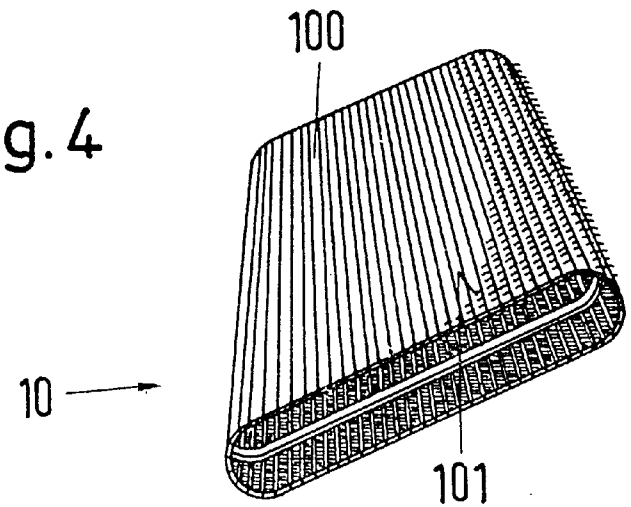
FIG. 4 shows an elevator lattice for the removal of fibre flocks from the mixer.

FIG. 4 shows an elevator lattice 10, as is used in the apparatus of FIG. 2 in accordance with the invention for removing fibres from the tower mixer. The elevator lattice 10 is arranged in the form of a spiked elevator lattice which, in the known manner, is used in spinning preparation machines as conveyor and opening member. It substantially consists of an endless fabric, a belt, and transversal rods 100 which are attached at small distances and in which inclined projecting steel pins 101 are inserted in order to produce the flock conveyance.

The invention therefore provides a combination of two units, namely:

- a unit for recognizing and separating foreign matter which requires the feed in a predetermined form and
- a further unit disposed upstream of the first unit which is designed for fulfilling another function, but thereby supplies the starting material in a form which meets the requirements of the first unit.

The transfer from the upstream to the downstream unit can occur without any substantial conveyance technology, in particular without pneumatic transport. The upstream unit can be arranged as a mixer for achieving a thorough mixture (e.g. of cotton assortments).

The feed required for the recognition or separating of foreign matter can be a lap, a fleece or a "wide" stream of flocks, for example. The term "wide stream of flocks" relates here to a stream as is normally produced in a so-called filling chute (e.g. according to EP-A-810 309), i.e. with a width which is substantially larger than its depth.

The downstream unit can be used merely for recognizing and detecting foreign matter (such as is proposed in EP-A-412 447, for example). The preferred solution, however, provides a combination of the recognition with the separation of the recognized foreign matter. The downstream unit thus is distinguished from a conventional "cleaning station" (e.g. according to U.S. Pat. No. 5,173,995) in that the separation (in a purposeful way) occurs depending on the recognition of the foreign matter, whereas the recognition is not provided or possible in a conventional cleaning station.

It will be apparent to those skilled in the art that various modifications and variations can be made in the present invention without departing from the scope and spirit of the invention. It is intended that the present invention include such modifications and variations as come within the scope of the appended claims and their equivalents.

What is claimed is:

1. A process for mixing and preparing fibers for processing in textile machinery, said process comprising mixing an incoming stream of fibers in a mixer; withdrawing the mixed fibers from the mixer with a withdrawal apparatus; supplying the withdrawn fibers from the withdrawal apparatus to a separating device disposed immediately downstream of the withdrawal apparatus in a conveying direction of the fibers in the form of a fiber fleece spread out transversely to the conveying direction of the fibers; and automatically examining the fiber fleece for foreign matter with the separating device, and cleaning such foreign matter from the fiber fleece in the separating device.

2. The process as in claim 1, further comprising conveying the cleaned fiber fleece with an airstream to a conveying device downstream of the separating device.

3. The process as in claim 1, wherein said cleaning step comprises blowing such foreign matter out of the fiber fleece with pneumatic nozzles.

4. The process as in claim 1, wherein said cleaning step comprises separating such foreign matter from the fiber fleece with actuable flaps.

5. The process as in claim 1, comprising conveying the fiber fleece through the separating device in a free-fall form.

6. A textile fiber spinning preparation device, comprising:

a mixer disposed to receive and mix a supply of fiber conveyed therethrough;

a withdrawal device disposed downstream of said mixer in a conveying direction of said fiber and configured for receiving mixed fibers from said mixer and forming said mixed fibers into a fiber fleece which is spread out transversely to said conveying direction; and a separating device disposed generally immediately downstream from said withdrawal device in said conveying direction to receive said fiber fleece, said separating device further comprising a sensor device to scan and detect foreign matter in said fiber fleece, and a removal device to separate detected foreign matter out of said fiber fleece.

7. The device as in claim 6, wherein said mixer comprises a tower mixer.

8. The device as in claim 6, wherein said withdrawal device comprises an elevator lattice.

9. The device as in claim 8, wherein said withdrawal device further comprises a stripping roller disposed to remove said fiber fleece from said elevator lattice.

10. The device as in claim 6, further comprising a conveying device disposed to convey fibers freed from foreign matter in said separating device downstream from said separating device for further processing.

11. The device as in claim 6, wherein said sensor device comprises an optical sensor.

12. The device as in claim 11, wherein said optical sensor detects said foreign matter by differences in color.

13. The device as in claim 6, wherein said removal device comprises at least one pneumatic device disposed downstream from said sensor to automatically blow detected foreign matter out of said fiber fleece.

14. The device as in claim 6, wherein said removal device comprises at least one actuable flapper device disposed downstream from said sensor to engage and divert detected foreign matter from said fiber fleece.

* * * * *